US011198538B2

(12) United States Patent
Goldstein

(10) Patent No.: US 11,198,538 B2
(45) Date of Patent: Dec. 14, 2021

(54) CLAMPING DOOR TRAY

(71) Applicant: Steven M. Goldstein, Herald, CA (US)

(72) Inventor: Steven M. Goldstein, Herald, CA (US)

( * ) Notice: Subject to any disclaimer, the term of this patent is extended or adjusted under 35 U.S.C. 154(b) by 198 days.

(21) Appl. No.: 16/563,911

(22) Filed: Sep. 8, 2019

(65) Prior Publication Data

US 2020/0115106 A1 Apr. 16, 2020

Related U.S. Application Data

(60) Provisional application No. 62/744,225, filed on Oct. 11, 2018.

(51) Int. Cl.

| | |
|---|---|
| ***B65D 25/22*** | (2006.01) |
| ***B65D 25/04*** | (2006.01) |
| ***B65D 25/10*** | (2006.01) |

(52) U.S. Cl.

CPC ..... *B65D 25/22* (2013.01); *B65D 25/04* (2013.01); *B65D 25/10* (2013.01)

(58) Field of Classification Search

CPC ..... B25B 11/00; B65D 11/10; B65D 21/0204; B65D 21/086; B65D 2313/00; B65D 25/04; B65D 25/10; B65D 25/22

USPC ..... 220/475, 480, 481, 7, 8; 248/333

See application file for complete search history.

(56) References Cited

U.S. PATENT DOCUMENTS 4,909,406 A * 3/1990 Wu ..... A45C 7/00 220/528

2005/0230393 A1* 10/2005 Testa ..... B60S 3/00 220/8

* cited by examiner

*Primary Examiner* — Don M Anderson
*Assistant Examiner* — Madison L Poos
(74) *Attorney, Agent, or Firm* — Kali Law Group, P.C.

(57) ABSTRACT

Clamping door trays are presented including: an open channel tray; a closed channel tray slidingly engaged with the open channel tray; a clamping mechanism positioned on an underside of the clamping door tray, the clamping mechanism for drawing the open channel tray and the closed channel tray together; and a support plate located along an inside bottom surface of the closed channel tray and secured through to the open channel tray. In some embodiments, the open channel tray includes: an L-shaped channel having a closed distal end and an open proximal end; and a rim located along a portion of a top edge of the L-shaped channel, the rim proceeding from the closed distal end, along an outside edge to the open proximal end.

14 Claims, 5 Drawing Sheets

CLAMPING DOOR TRAY

BACKGROUND

Door installation, maintenance, and removal operations require a variety of tools and hardware. Often the hardware may be very small and easily lost. This problem may be exacerbated by a technician constantly reaching for different tools during the various operations. Until now, trays set on the ground were the best way to control small parts. Unfortunately, a tray placed on the ground is subject to being upset by the technician's movement however careful. Furthermore, because some door hardware needs to be held in place while switching tools, keeping tools close and on the floor may introduce further trip hazards to the technician. Additionally, if tools are kept clear of the area, it may be necessary to repeat an operation because a tool is too far to reach without losing placement of a particular piece of hardware.

As such, clamping door trays are provided herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, clamping door trays are presented including: an open channel tray; a closed channel tray slidingly engaged with the open channel tray; a clamping mechanism positioned on an underside of the clamping door tray, the clamping mechanism for drawing the open channel tray and the closed channel tray together; and a support plate located along an inside bottom surface of the closed channel tray and secured through to the open channel tray. In some embodiments, the open channel tray includes: an L-shaped channel having a closed distal end and an open proximal end; and a rim located along a portion of a top edge of the L-shaped channel, the rim proceeding from the closed distal end, along an outside edge to the open proximal end. In some embodiments, the open channel tray further includes: a number of tray separators located along an inside bottom surface of the open channel tray. In some embodiments, the closed channel tray includes: an L-shaped channel having a closed distal end and a closed proximal end; and a rim located along a portion of a top edge of the L-shaped channel, the rim proceeding from the closed distal end, along an outside edge to the closed proximal end; and a pair of raised guides proximate with the closed proximal end; and a slot positioned between the pair of raised guides. In some embodiments, the support plate includes: a number of raised ridges located along a top surface of the support plate; a pair of guide grooves located along a bottom surface of the support plate and perpendicular to the number of raised ridges, the guide groves configured to slidingly engage with the raised guides; and a raised edge located along the top surface of the support plate. In some embodiments, the clamping mechanism includes: a pair of opposing clamp supports; a clamping screw and clamping nut for engaging the pair of opposing clamp supports; and a pair of reinforced clamping pads adjacent to the pair of clamp supports, the pair of reinforced clamping pads configured for clamping a front surface and a back surface of a door.

In other embodiments, methods for using a clamping door tray are presented including: providing the clamping door tray, where the clamping door tray includes: an open channel tray; a closed channel tray slidingly engaged with the open channel tray; a clamping mechanism positioned on an underside of the clamping door tray, the clamping mechanism for drawing the open channel tray and the closed channel tray together; and a support plate located along an inside bottom surface of the closed channel tray and secured through to the open channel tray; adjusting the clamping mechanism to accommodate a selected door; positioning the clamping door tray along a leading edge of the selected door; and adjusting the clamping mechanism to provide a clamping force on a front surface and a back surface of the door. In some embodiments, methods further include: adjusting the clamping mechanism to remove the clamping force from the front and back surfaces of the door; and removing the clamping door tray from the selected door.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
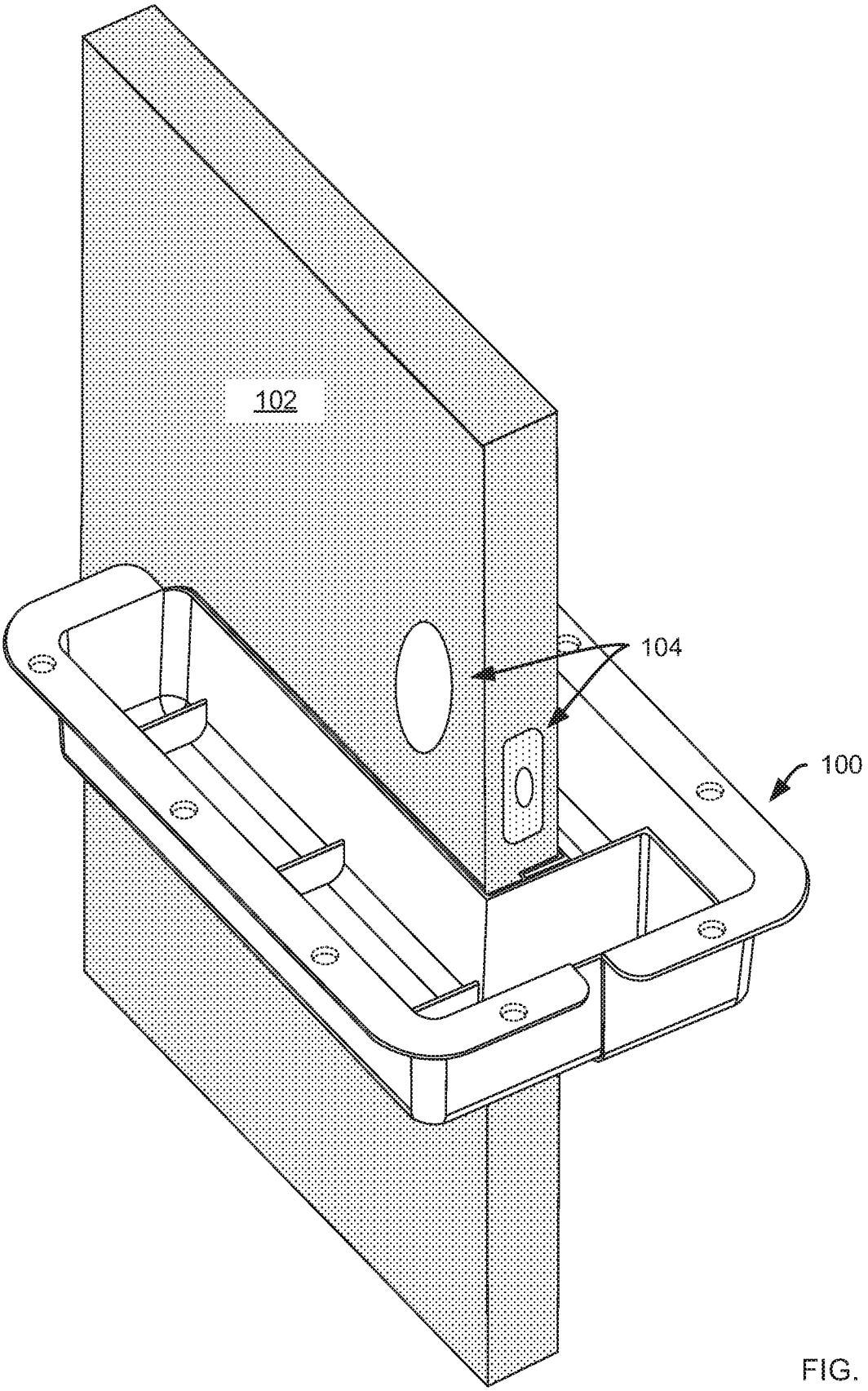
FIG. 1 is an illustrative representation of a clamping door tray in use in accordance with embodiments of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

In still other instances, specific numeric references such as "first material," may be made. However, the specific numeric reference should not be interpreted as a literal sequential order but rather interpreted that the "first material" is different than a "second material." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

As illustrated in the following figures, door caddy embodiments include a U-shaped, two-part, tray assembly that temporally affixes to an existing door by way of an integrated clamping system. Door caddy embodiments include trays that wrap around a door edge. Each tray includes a number of separators for organizing small parts. The trays may hold tools or chips as required in use. An upper edge band is useful for directing chips into the trays and for providing a clamping surface for tools such as lights, for example. Holes or slots positioned around the upper edge band may be used to hold screw drivers or other tools used to install or service a door lock. Embodiments may be manufactured from any of a number of materials including metal materials, polymeric materials, or combinations thereof.

At least some of the advantages of embodiment disclosed include:

Catching falling debris that occurs when drilling holes in the face or edge of a door for new or replacement hardware;

Holding hand tools such as screwdrivers, chisels, cordless drills etc.;

Providing an upper edge band or rim on the door caddy allows for clamp-on illumination;

Providing magnetic holders for metal objects;

Providing storage compartments for small screws, drill bits, etc.; and

Providing a tray for rekeying or repairing locks.

In embodiments, notable features may include:

Lightweight, durable, high impact ABS plastic material;

Integrated screw clamping system;

Sliding mechanism to allow fit to various door thicknesses;

Replaceable cushions to protect door and provide more clamping friction;

Adjusts to any door thickness from 1" to 2.5";

Non-marring, non-corrosive material;

Edge rib for strength and to allow a clamp-on illumination device; and

Tray dividers for added tray strength and to provide convenient storage and separation of miscellaneous hardware, screws, drill bits, etc.

FIG. 1 is an illustrative representation of a clamping door tray 100 in use in accordance with embodiments of the present invention. In particular, clamping door tray 100 is positioned along the edge of door 102 and placed below door knob/lock installation area 104. In placing clamping door tray 100 below the installation area, hardware such as tools, fasteners, locks, knobs, strike plates, etc. may be located at or near the work area. In addition, in new installations, embodiments provide a chip catcher during installation operations. Embodiments include the ability to position the clamping door tray anywhere along the edge of a door. Further features of clamping door tray embodiments will be further disclosed below.

Figure 2:
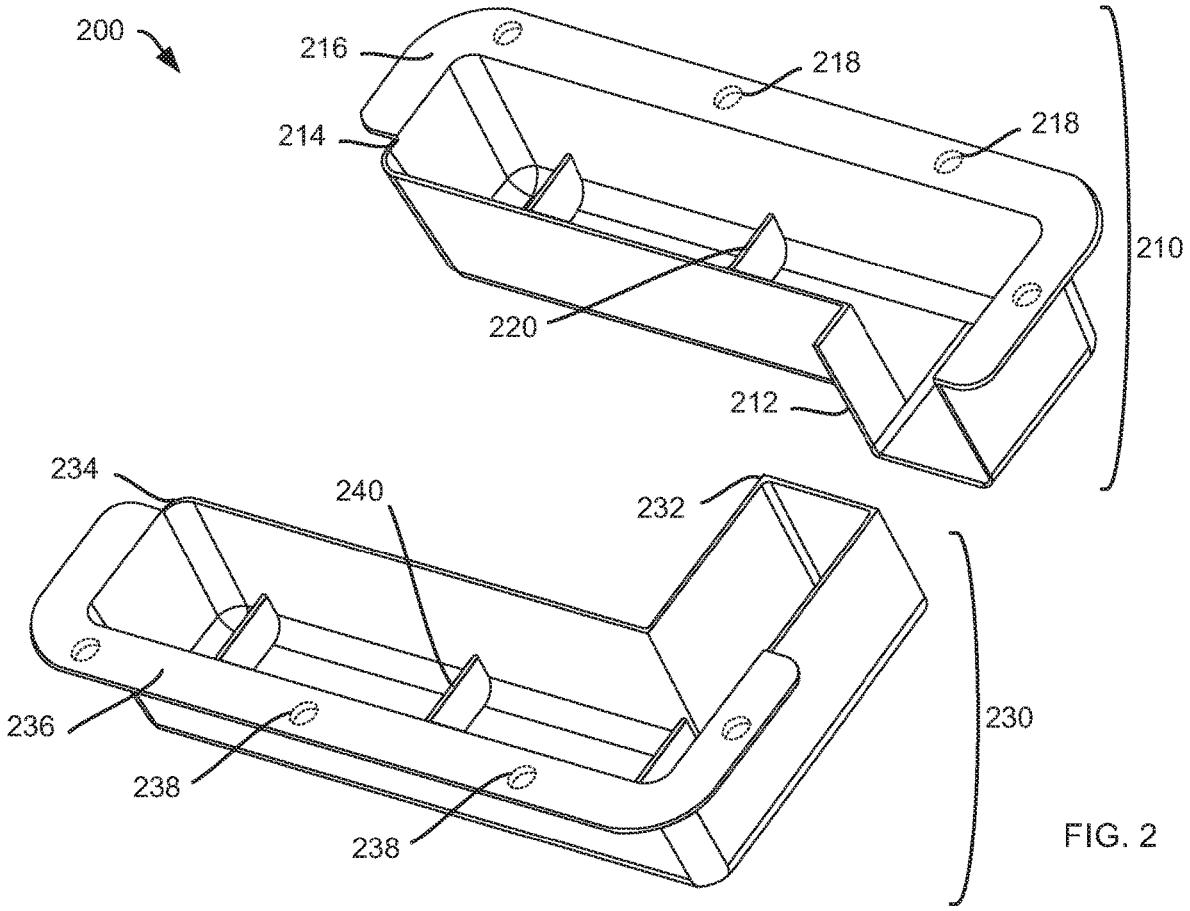
FIG. 2 is an illustrative exploded top view representation of a clamping door tray in accordance with embodiments of the present invention.

FIG. 2 is an illustrative exploded top view representation of clamping door tray 200 in accordance with embodiments of the present invention. As illustrated, clamping door tray 200 includes open channel tray 210. Open channel tray embodiments are L-shaped and include open proximal end 212 and closed distal end 214. Open channel tray embodiments further include rim 216 located along a portion of the top edge of the L-shaped channel, proceeding from closed distal end 214 to open proximal end 212. Additionally, rim 216 may include, in some embodiments, a number of holes 218 for receiving tools such as, for example, screw drivers, nut drivers, picks, etc. Further illustrated are a number of separators 220 located along an inside bottom surface of open channel tray 210. In embodiments, separators serve to provide additional support structures for the tray as well as to provide compartments for separating parts.

Further illustrated is closed channel tray 230 that may be slidingly engaged with open channel tray 210. Closed channel tray embodiments are L-shaped and include closed proximal end 232 and closed distal end 234. Closed channel tray embodiments further include rim 236 located along a portion of the top edge of the L-shaped channel, proceeding from closed distal end 234 to closed proximal end 232. Additionally, rim 236 may include, in some embodiments, a number of holes 238 for receiving tools such as, for example, screw drivers, nut drivers, picks, etc. Further illustrated are a number of separators 240 located along an inside bottom surface of closed channel tray 230. In embodiments, separators serve to provide additional support structures for the tray as well as to provide compartments for separating parts.

Figure 3:
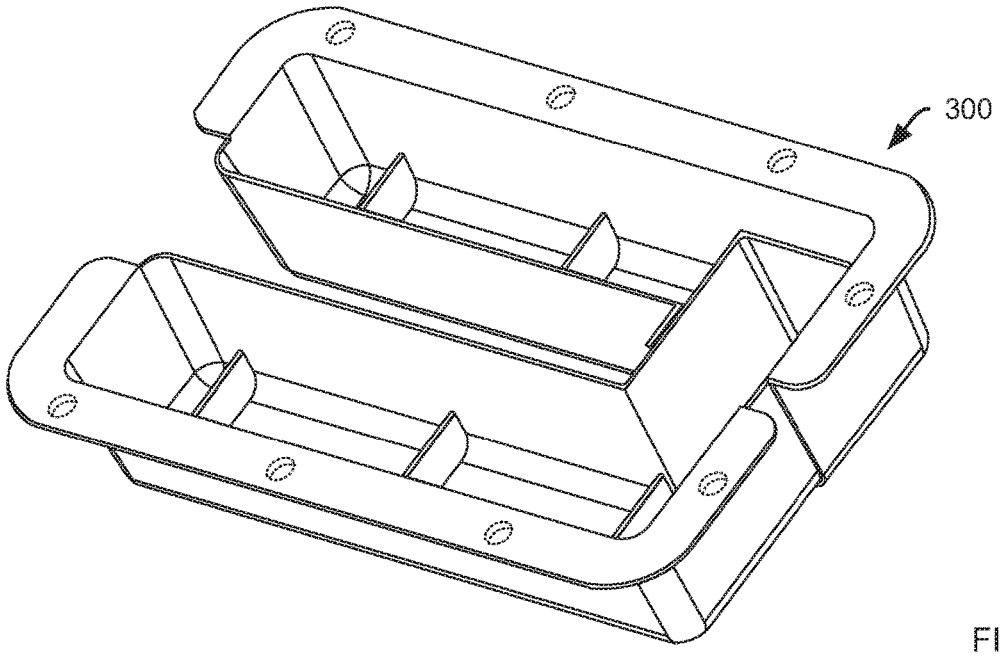
FIG. 3 is an illustrative assembled top view representation of a clamping door tray in accordance with embodiments of the present invention.

FIG. 3 is an illustrative assembled top view representation of clamping door tray 300 in accordance with embodiments of the present invention. In particular, FIG. 3 illustrates closed channel tray 230 (FIG. 2) slidingly engaged with open channel tray 210 (FIG. 2). This arrangement allows clamping door tray embodiments to accommodate a variety of door thicknesses.

Figure 4:
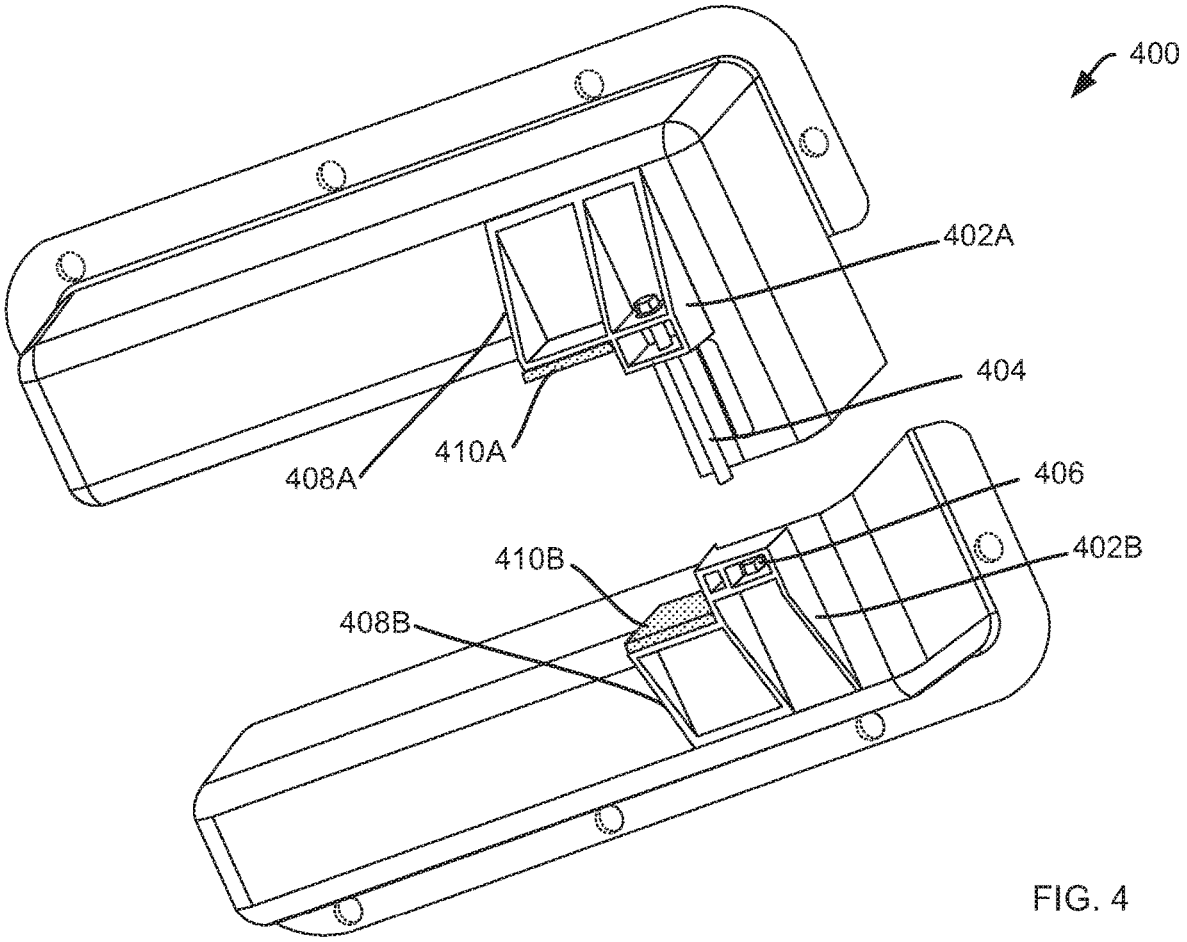
FIG. 4 is an illustrative exploded bottom view representation of a clamping door tray in accordance with embodiments of the present invention.

FIG. 4 is an illustrative exploded bottom view representation of clamping door tray 400 in accordance with embodiments of the present invention. As illustrated, clamping door tray 400 includes a pair of opposing clamp supports 402A and 402B in mechanical cooperation with clamping screw 404 and clamping nut 406. As may be seen, clamping screw 404 and clamping nut 406 engaging the pair of opposing clamp supports 402A and 402B. The clamping force generated allowed clamping door tray embodiments to be positioned anywhere along a door edge. The clamping force is applied by a pair of reinforced clamping pads 408A and 408B that are located adjacent to the pair of clamp supports and are configured for clamping a front surface and a back surface of a door. In addition, in some embodiments, a non-marring pad 410A and 410B may be provided to protect door surfaces.

Figure 5:
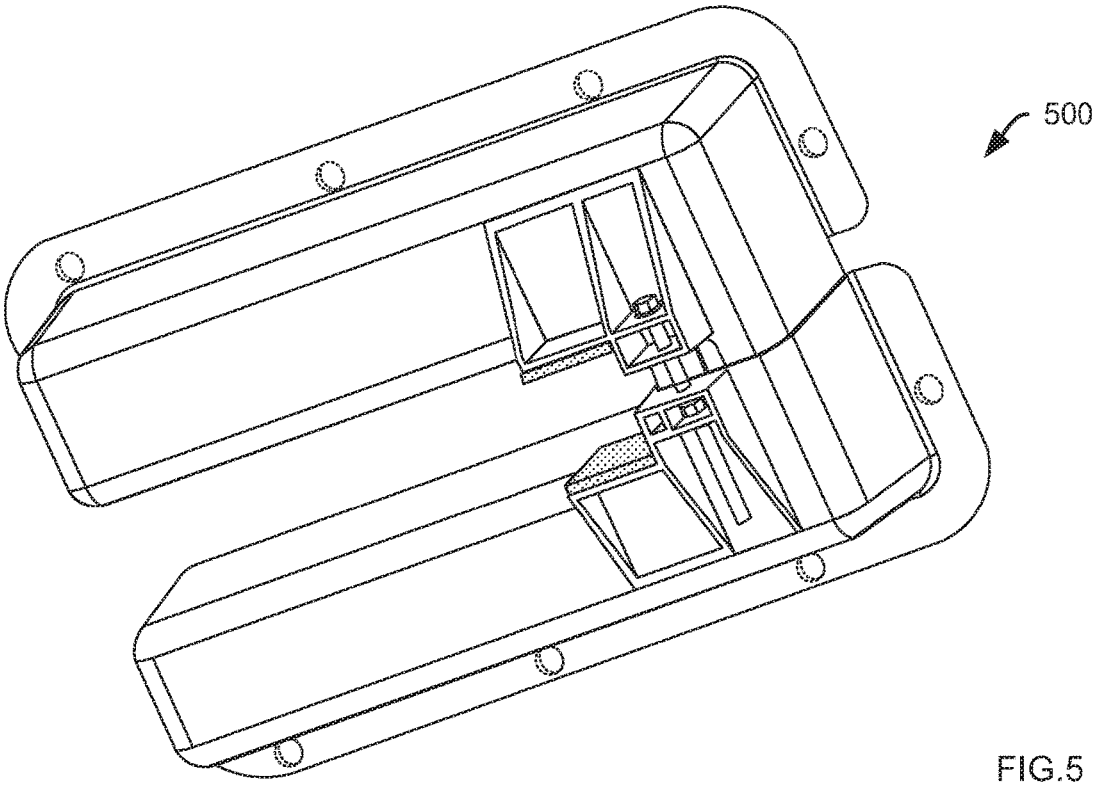
FIG. 5 is an illustrative assembled bottom view representation of a clamping door tray in accordance with embodiments of the present invention.

FIG. 5 is an illustrative assembled bottom view representation of clamping door tray 500 in accordance with embodiments of the present invention. In particular, FIG. 5 illustrates closed channel tray 230 (FIG. 2) slidingly engaged with open channel tray 210 (FIG. 2). This arrangement allows clamping door tray embodiments to accommodate a variety of door thicknesses.

Figure 6:
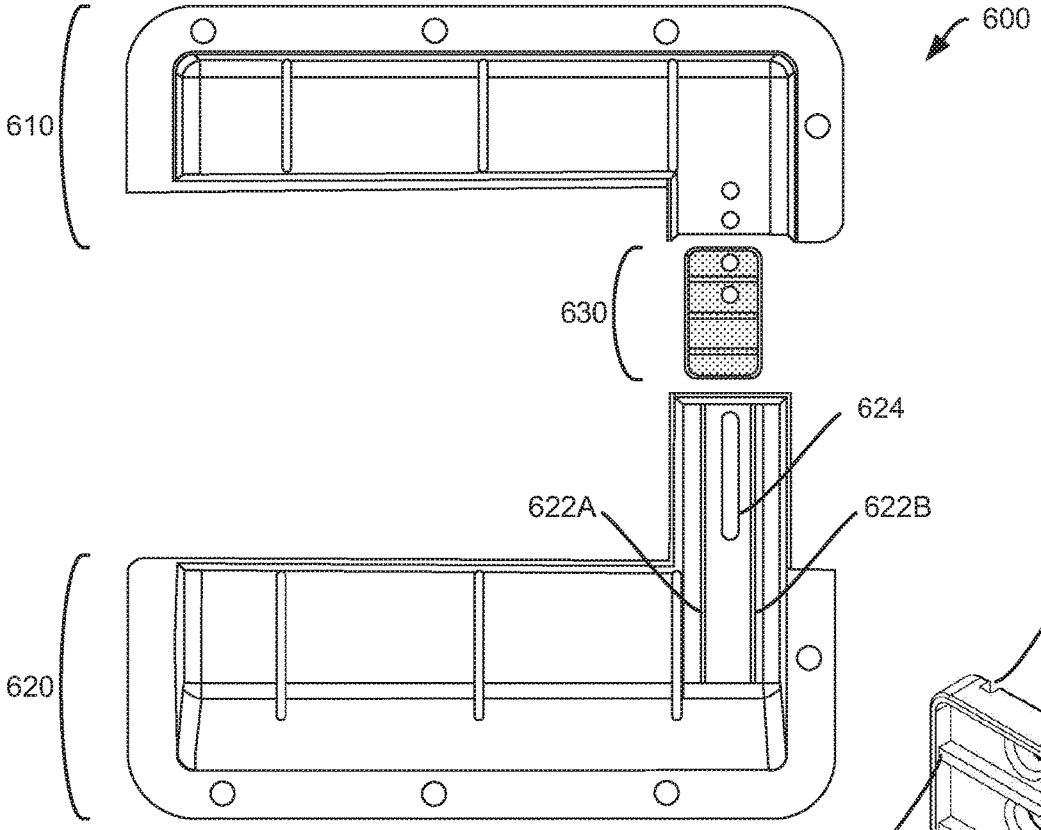
FIG. 6 is an illustrative exploded top view representation of a clamping door tray with support plate in accordance with embodiments of the present invention.

FIG. 6 is an illustrative exploded top view representation of clamping door tray 600 with support plate 630 in accordance with embodiments of the present invention. As illustrated, clamping door tray 600 includes open channel tray 610 and closed channel tray 620. Further illustrated are raised guides 622A and 622B proximate with the closed proximal end. Raised guides are positioned to slidingly engaged support plate 630 and support the clamping door tray. In addition, slot 624 is positioned between the raised guides and allows the open channel tray and the closed channel tray to slide with respect to one another.

Figure 7:
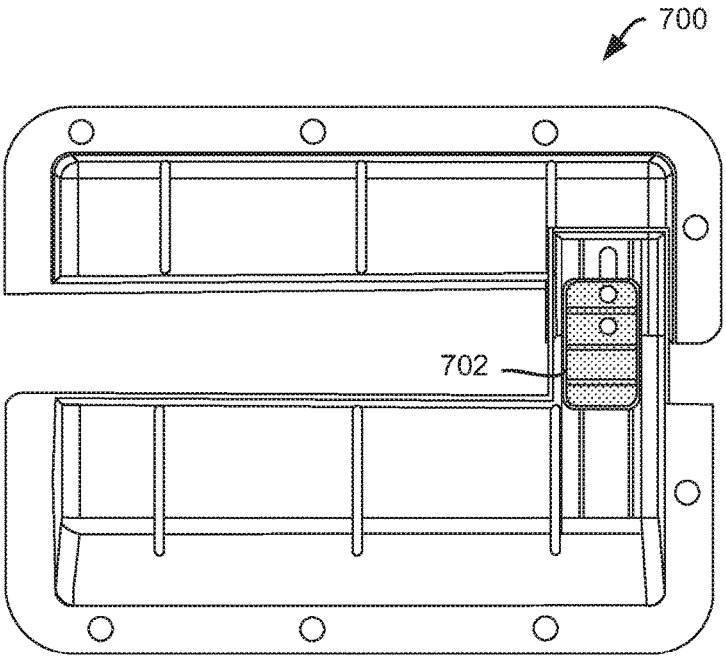
FIG. 7 is an illustrative assembled top view representation of a clamping door tray with support plate in accordance with embodiments of the present invention.

FIG. 7 is an illustrative assembled top view representation of clamping door tray 700 with support plate 702 in accordance with embodiments of the present invention In particular, FIG. 7 illustrates closed channel tray 620 (FIG. 6) slidingly engaged with open channel tray 610 (FIG. 6). This arrangement allows clamping door tray embodiments to accommodate a variety of door thicknesses.

Figure 8:
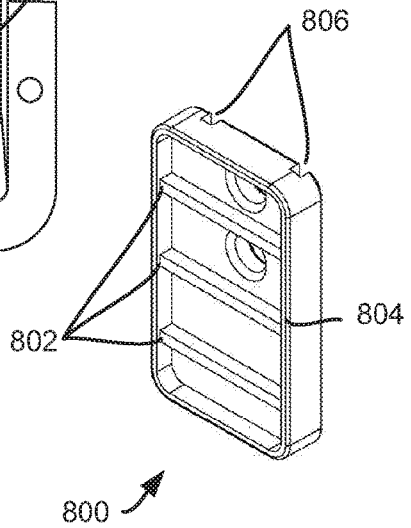
FIG. 8 is an illustrative representation of a support plate in accordance with embodiments of the present invention.

FIG. 8 is an illustrative representation of support plate 800 in accordance with embodiments of the present invention. As illustrated support plate embodiments include raised ridges 802 and raised edge 804 located along a top surface of support plate 800. The raised ridges and raised edge provide additional mechanical strength for support plate embodiments. Further illustrated are guide grooves 806 located along a bottom surface of the support plate and perpendicular to the raised ridges. Guide groves 806 are configured to slidingly engage with the raised guides 622A and 622B (FIG. 6).

Figure 9:
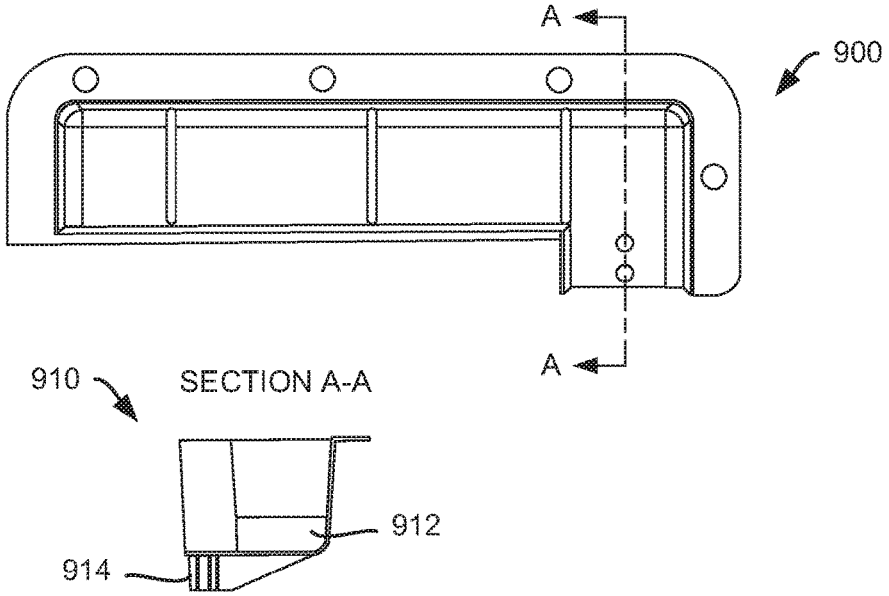
FIG. 9 is an illustrative representation of an open channel tray in profile in accordance with embodiments of the present invention.

FIG. 9 is an illustrative representation of an open channel tray 900 in profile 910 in accordance with embodiments of the present invention. As illustrated, profile labeled "SECTION A-A" is approximately U-shaped in embodiments. As may be appreciated, while the illustrated profile is approximately U-shaped, other shaped profiles may be utilized without limitation and without departing from embodiments provided herein. Further illustrated are separator 912 and opposing clamp support 914.

Figure 10:
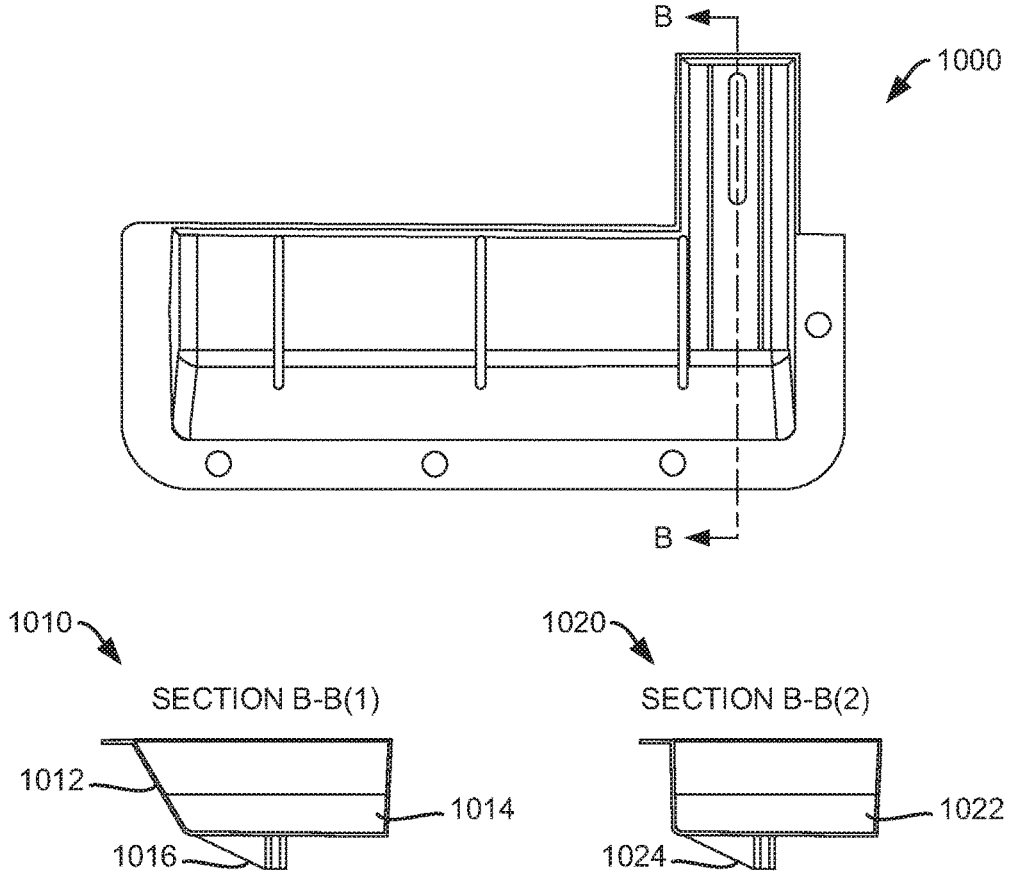
FIG. 10 is an illustrative representation of a closed channel tray in profile in accordance with embodiments of the present invention.

FIG. 10 is an illustrative representation of a closed channel tray 1000 in profile 1010 and 1020 in accordance with embodiments of the present invention. As illustrated, profile labeled "SECTION B-B (1)" 1010 includes a sloped outside wall 1012 in embodiments. A sloped outside wall may be useful in some embodiments to make small hardware items like screws, bolts, and pins more accessible. In addition, separator 1014 and opposing clamp support 1016 are illustrated. Further illustrated is profile labeled "SECTION B-B (2)" 1020 that is approximately U-shaped in embodiments. In addition, separator 1022 and opposing clamp support 1024 are illustrated.

Methods of Use

Methods for using clamping door tray embodiments include the steps of:

Providing the clamping door tray;

Adjusting the clamping mechanism to accommodate a selected door;

Positioning the clamping door tray along a leading edge of the selected door; and Adjusting the clamping mechanism to provide clamping force on the front and back surfaces of the door.

Additional steps include:

Adjusting the clamping mechanism to remove the clamping force from the front and back surfaces of the door; and Removing the clamping door tray from the selected door.

While installed, installation operations, maintenance operations, and removal operations may be performed on door hardware such as knobs, levels, locks, handles, strikes, latches, bolts, and the like without limitation and without departing from embodiments disclosed herein.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A clamping door tray comprising:

an open channel tray;

a closed channel tray slidingly engaged with the open channel tray;

a clamping mechanism positioned on an underside of the clamping door tray, the clamping mechanism for drawing the open channel tray and the closed channel tray together, wherein the clamping mechanism comprises:

a pair of opposing clamp supports;

a clamping screw and clamping nut for engaging the pair of opposing clamp supports; and a pair of reinforced clamping pads adjacent to the pair of clamp supports, the pair of reinforced clamping pads configured for clamping a front surface and a back surface of a door; and a support plate located along an inside bottom surface of the closed channel tray and secured through to the open channel tray.

2. The clamping door tray of claim 1, wherein the open channel tray comprises:

a first L-shaped channel having a first closed distal end and an open proximal end; and a first rim located along a first portion of a first top edge of the first L-shaped channel, the first rim proceeding from the first closed distal end, along a first outside edge to the open proximal end.

3. The clamping door tray of claim 2, wherein the first rim further comprises:

a first plurality of tool holes for receiving tools.

4. The clamping door tray of claim 1, wherein the open channel tray further comprises:

a first plurality of tray separators located along an inside bottom surface of the open channel tray.

5. The clamping door tray of claim 1, wherein the closed channel tray comprises:

a L-shaped channel having a closed distal end and a closed proximal end; and a rim located along a portion of a top edge of the second L-shaped channel, the second rim proceeding from the second closed distal end, along an outside edge to the closed proximal end;

and a pair of raised guides proximate with the closed proximal end; and a slot positioned between the pair of raised guides.

6. The clamping door tray of claim 5, wherein the second rim further comprises:

a plurality of tool holes for receiving tools.

7. The clamping door tray of claim 1, wherein the closed channel tray further comprises:

a plurality of tray separators located along the inside bottom surface of the closed channel tray.

8. The clamping door tray of claim 5, wherein the support plate comprises:

a plurality of raised ridges located along a top surface of the support plate;

a pair of guide grooves located along a bottom surface of the support plate and perpendicular to the plurality of raised ridges, the guide groves configured to slidingly engage with the raised guides; and a raised edge located along the top surface of the support plate.

9. A method for using a clamping door tray comprising:

providing the clamping door tray, wherein the clamping door tray comprises:

an open channel tray;

a closed channel tray slidingly engaged with the open channel tray;

a clamping mechanism positioned on an underside of the clamping door tray, the clamping mechanism for drawing the open channel tray and the closed channel tray together, wherein the clamping mechanism comprises:

a pair of opposing clamp supports;

a clamping screw and clamping nut for engaging the pair of opposing clamp supports; and a pair of reinforced clamping pads adjacent to the pair of clamp supports, the pair of reinforced clamping pads configured for clamping a front surface and a back surface of a door; and a support plate located along an inside bottom surface of the closed channel tray and secured through to the open channel tray;

adjusting the clamping mechanism to accommodate a selected door;

positioning the clamping door tray along a leading edge of the selected door; and adjusting the clamping mechanism to provide a clamping force on a front surface and a back surface of the door.

10. The method of claim 9, further comprising:

adjusting the clamping mechanism to remove the clamping force from the front and back surfaces of the door; and removing the clamping door tray from the selected door.

11. The method of claim 9, wherein the open channel tray comprises:

a first L-shaped channel having a first closed distal end and an open proximal end; and a first rim located along a first portion of a first top edge of the first L-shaped channel, the first rim proceeding from the first closed distal end, along a first outside edge to the open proximal end.

12. The method of claim 9, wherein the closed channel tray comprises:

a L-shaped channel having a closed distal end and a closed proximal end; and a rim located along a portion of a top edge of the second L-shaped channel, the second rim proceeding from the second closed distal end, along an outside edge to the closed proximal end;

and a pair of raised guides proximate with the closed proximal end; and a slot positioned between the pair of raised guides.

13. The method of claim 9, wherein the support plate comprises:

a plurality of raised ridges located along a top surface of the support plate;

a pair of guide grooves located along a bottom surface of the support plate and perpendicular to the plurality of raised ridges, the guide groves configured to slidingly engage with the raised guides; and a raised edge located along the top surface of the support plate.

14. A clamping door tray comprising:

an open channel tray wherein the open channel tray comprises:

a first L-shaped channel having a first closed distal end and an open proximal end; and a first rim located along a first portion of a first top edge of the first L-shaped channel, the first rim proceeding from the first closed distal end, along a first outside edge to the open proximal end, wherein the first rim comprises: a first plurality of tool holes for receiving tools; and a closed channel tray slidingly engaged with the open channel tray;

a clamping mechanism positioned on an underside of the clamping door tray, the clamping mechanism for drawing the open channel tray and the closed channel tray together; and a support plate located along an inside bottom surface of the closed channel tray and secured through to the open channel tray.

* * * * *